US006302527B1

(12) United States Patent
Walker

(10) Patent No.: US 6,302,527 B1
(45) Date of Patent: Oct. 16, 2001

(54) METHOD AND APPARATUS FOR TRANSFERRING INFORMATION BETWEEN A PRINTER PORTION AND A REPLACEABLE PRINTING COMPONENT

(75) Inventor: Ray A. Walker, Eugene, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/415,331

(22) Filed: Oct. 8, 1999

Related U.S. Application Data

(63) Continuation-in-part of application No. 09/295,080, filed on Apr. 20, 1999, and a continuation-in-part of application No. 09/410,989, filed on Oct. 1, 1999.

(51) Int. Cl.[7] ..... B41J 2/14

(52) U.S. Cl. ..... 347/50

(58) Field of Search ..... 347/86, 87, 50, 347/19, 7

(56) References Cited

U.S. PATENT DOCUMENTS

| | | | | |
|---|---|---|---|---|
| 4,415,886 | | 11/1983 | Kyogoku et al. | 340/618 |
| 4,636,814 | | 1/1987 | Terasawa | 607/154 |
| 4,857,893 | | 8/1989 | Carroll | 454/182 |
| 5,049,898 | * | 9/1991 | Arthur et al. | 347/19 |
| 5,266,968 | * | 11/1993 | Stephenson | 347/172 |
| 5,528,222 | | 6/1996 | Muskowitz et al. | 340/572.7 |
| 5,682,140 | | 10/1997 | Christensen et al. | 340/540 |
| 5,699,091 | * | 12/1997 | Bullock et al. | 347/19 |
| 5,788,388 | | 8/1998 | Cowger et al. | 400/703 |
| 5,838,253 | | 11/1998 | Wurz et al. | 340/10.42 |
| 5,930,553 | | 7/1999 | Hirst et al. | 399/8 |
| 6,039,430 | * | 3/2000 | Helterline et al. | 347/19 |

FOREIGN PATENT DOCUMENTS

| | | | |
|---|---|---|---|
| 0856725A1 | 8/1998 | (EP) . | |
| WO/97/28001 | 8/1997 | (WO) . | |
| WO/98/52762 | 11/1998 | (WO) | B41J/2/01 |

OTHER PUBLICATIONS

"RFID: Everything You Need to Know," Motorola, Inc., Nov. 11, 1997 (18 pgs.).

"MicroStamp 4000–1 Interrogator, Technical Information," Micron Communications, Inc., Sep. 1, 1998 (pp 1–13).

Hook, Chris, "The Application of RFID Tags as Anti–Counterfeiting Devices, " Texas Instruments, http://www.ti-.com, 1997, pp. 1–10.

* cited by examiner

*Primary Examiner*—N. Le
*Assistant Examiner*—Michael Nghiem
(74) *Attorney, Agent, or Firm*—Kevin B. Sullivan

(57) ABSTRACT

The present disclosure relates to a replaceable printing component for use in a printing system. The replaceable printing component is configured for containing a supply of printing material for use by the printing system to form images on media. The replaceable printing component includes a sensor for sensing printing material in the replaceable printing component. The sensor provides a sensor output signal that is indicative of a printing material level in the replaceable printing component. Also included is a linking device that is electrically connected to the sensor. The linking device emits a broadcast signal that is indicative of the sensor output signal. The inkjet printing system receives the broadcast signal for determining the printing material level in the replaceable printing component.

21 Claims, 6 Drawing Sheets

METHOD AND APPARATUS FOR TRANSFERRING INFORMATION BETWEEN A PRINTER PORTION AND A REPLACEABLE PRINTING COMPONENT

CROSS REFERENCE TO RELATED APPLICATIONS

This application is a continuation-in-part of patent application entitled, "Method and Apparatus for Transferring Information Between a Replaceable Consumable and a Printing Device," Ser. No. 09/295,080, filed Apr. 20, 1999, and a continuation-in-part of patent application entitled, "Method and Apparatus for Identifying a Sales Channel", Ser. No. 09/410,989, filed Oct. 1, 1999, both of which are assigned to the assignee of the present invention, and incorporated herein by reference.

BACKGROUND OF THE INVENTION

The present invention is related to inkjet printing devices. More particularly, the present invention is related to inkjet printing devices that make use of a wireless link for transferring ink level information from a replaceable ink container to a printer portion.

Inkjet printers frequently make use of an inkjet printhead mounted within a carriage that is moved back and forth across print media, such as paper. As the printhead is moved across the print media, a control system activates the printhead to deposit or eject ink droplets onto the print media to form images and text. Ink is provided to the printhead by a supply of ink that is either carried by the carriage or mounted to the printing system so as not to move with the carriage. For the case where the ink supply is not carried with the carriage, the ink supply can be in fluid communication with the printhead to replenish the printhead or the printhead can be intermittently connected with the ink supply by positioning the printhead proximate to the filling station whereupon the printhead is replenished with ink from the refilling station.

For the case where the ink supply is carried with the carriage, the ink supply may be integral with the printhead whereupon the entire printhead and ink supply is replaced when ink is exhausted. Alternatively, the ink supply can be carried with the carriage and be separately replaceable from the printhead or drop ejection portion.

Regardless of where the supply of ink is located within the printing system, it is critical that the printhead be prevented from operating when the supply of ink is exhausted. Operation of the printhead once the supply of ink is exhausted results in poor print quality, printhead reliability problems, and, if operated for a sufficiently long time without a supply of ink, can cause catastrophic failure of the printhead. This catastrophic failure results in permanent damage to the printhead. Therefore, it is important that the printing system be capable of reliably identifying a condition in which the ink supply is nearly or completely exhausted. This technique should be accurate, reliable, and relatively low cost, thereby tending to reduce the cost of the printing system.

SUMMARY OF THE INVENTION

The present invention includes a printing system having a printer portion and at least one replaceable printing component. The printer portion and the at least one replaceable printing component are configured for exchanging information therebetween. The printing system includes a first wireless link associated with the replaceable printing component. The wireless link is electrically connected to a sensor for sensing status of the replaceable printing component. The printing system includes a second wireless link associated with the printer portion. The second wireless link receives the replaceable printing component status information from the first wireless link for determining status of the replaceable printing component.

In one preferred embodiment, the first wireless link is a radio frequency transmitter for transmitting a radio frequency signal having replaceable printing component status information contained therein. The second wireless link is a radio frequency receiver for receiving the radio frequency signal and determining the replaceable printing component status based thereon.

Another aspect of the present invention is a replaceable printing component for use in a printing system. The replaceable printing component is configured for containing a supply of printing material for use by the printing system to form images on media. The replaceable printing component includes a sensor for sensing printing material in the replaceable printing component. The sensor provides a sensor output signal that is indicative of a printing material level in the replaceable printing component. Also included is a linking device that is electrically connected to the sensor. The linking device emits a broadcast signal that is indicative of the sensor output signal. The inkjet printing system receives the broadcast signal for determining the printing material level in the replaceable printing component.

DETAILED DESCRIPTION OF THE PREFERRED EMBODIMENT

Figure 1:
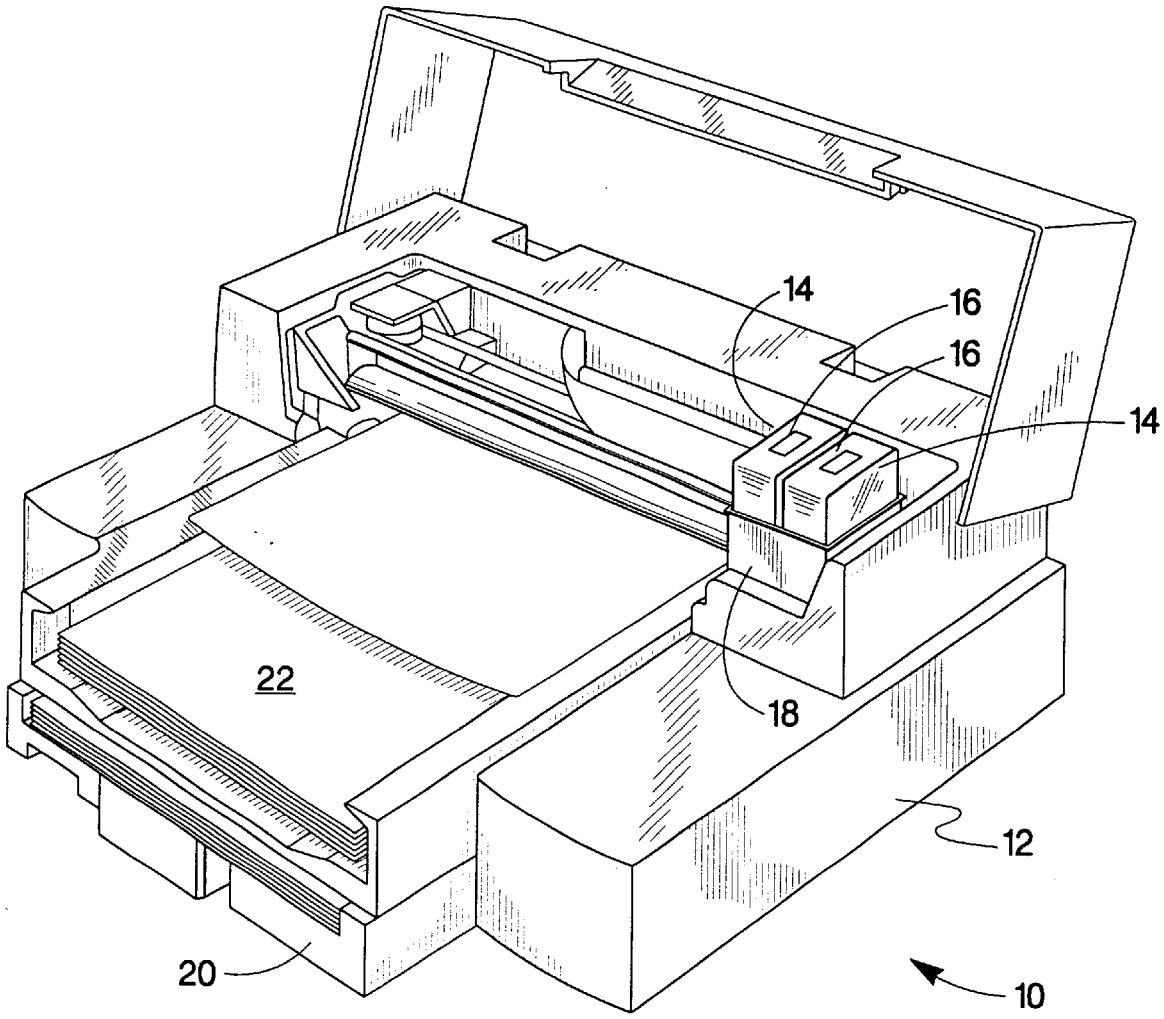
FIG. 1 depicts an exemplary embodiment of a printing system of the present invention that incorporates a replaceable printing component, shown in a top perspective view with a printer cover open.

FIG. 1 is a perspective view of one exemplary embodiment of a printing system 10 of the present invention shown with its cover open. The printing system 10 includes a printer portion 12 and one or more replaceable printing components 14 installed therein. The printer portion 12, together with the replaceable printing component(s) 14, accomplish printing on print media. Each replaceable printing component 14 includes a linking device 16 for exchanging status information between the printer portion 12 and the replaceable printing component 14. The use of the linking device 16, together with a corresponding linking device (not shown) associated with the printer portion 12, allows the printer portion 12 to monitor status of the replaceable printing components 14.

In one preferred embodiment, the printing system 10 is an inkjet printing system. For the inkjet printing system 10 shown in FIG. 1, the replaceable printing component 14 is an ink reservoir that is in fluid communication with an inkjet printhead portion that will be discussed with respect to FIG. 2. Each of the replaceable printing components 14 or ink reservoirs are installed in a scanning carriage 18 that is moved relative to print media. The inkjet printer portion 12 includes a media tray 20 for receiving print media 22. As media step through a print zone, the scanning carriage moves the replaceable printing components 14 and printheads relative to the print media 22. The printer portion 12 selectively activates the printhead portion associated with the replaceable printing components 14 to deposit ink on print media to thereby accomplish printing.

The printing system shown in FIG. 1 is shown with two replaceable printing components 14, one representing an ink reservoir having separate chambers containing cyan, magenta and yellow inks, and one representing an ink reservoir containing black ink. The replaceable printing components 14 are used together to accomplish 4-color printing. The method and apparatus of the present invention are also applicable to printing systems 10 that make use of other arrangements such as printing systems that use greater or less than 4 ink colors, as in high fidelity printing which typically use 6 or more ink colors. In either case, the printing system 10 includes one or more replaceable printing components 14, each having a linking device 16 associated therewith for providing status information to the printer portion 12.

The method and apparatus of the present invention is applicable to inkjet printing systems 10 having other configurations than those shown in FIG. 1. For example, the replaceable printing component 14 can be a printhead portion mounted on the scanning carriage 18, or a separate ink reservoir portion mounted off the scanning carriage that is in fluid communication either intermittently or continuously with the printhead portion. In this case, each of the printhead portion and the ink reservoir portion is a separate replaceable printing component 14. The ink reservoir portion is replaced when the ink is exhausted and the printhead portion is replaced at the end of life.

The method and apparatus of the present invention is applicable to replaceable components 14 other than the ink reservoir. For example, the present invention is suitable for use with any component that is subject to wear or is replaced periodically, such as motors and service stations for servicing the printhead, to name a few. The present invention allows the status of each of these replaceable printing components 14 to be determined by the printer portion 12. The customer is notified when a replaceable printing component requires replacement.

Figure 2:
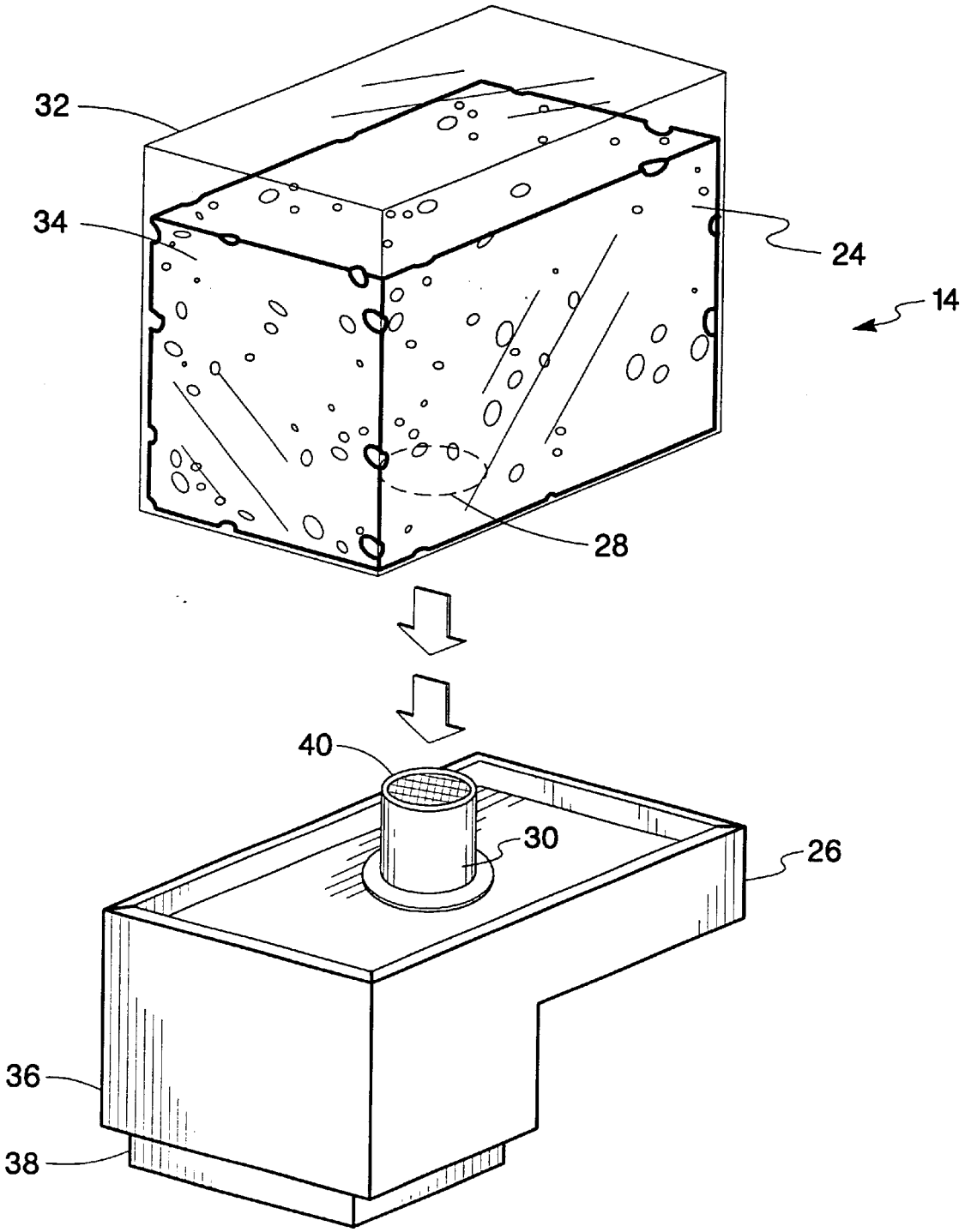
FIG. 2 is a simplified perspective view of a replaceable printhead portion and a replaceable ink reservoir portion for use in the printing system shown in FIG. 1.

FIG. 2 is a simplified representation of the replaceable printing component 14 shown as having two separately replaceable parts, an ink reservoir portion 24 and a printhead portion 26. For simplicity, the linking device 16 is not shown attached to either of these replaceable printing components 14. In addition, for simplicity, the ink reservoir 24 is shown as a single chamber ink reservoir containing one ink color. The ink reservoir 24 includes a fluid outlet 28 that is configured for coupling with a fluid inlet 30 associated with the printhead portion 26 when the reservoir portion is properly inserted into the printhead portion 26.

The reservoir portion 24 includes a housing 32, shown in ghost, for containing a supply of ink. In one embodiment, the ink reservoir 24 includes a porous material 34 having a capillary gradient therein such as foam material. The capillary gradient tends to draw ink within the ink reservoir 24 toward the fluid outlet 28. In addition, the porous material 34 provides backpressure for preventing ink from drooling from the printhead portion 24 in the event of temperature or pressure changes.

The printhead portion 26 includes a housing 36 and a printhead 38. The housing 36 supports the ink reservoir 24. The housing provides fluid communication between the fluid inlet 30 to the printhead 38 so that ink provided to the fluid inlet 30 flows to the printhead portion 38. In the preferred embodiment, the fluid inlet 30 includes a mesh portion 40 for engaging and compressing the porous material 34 within the ink reservoir 24 when the reservoir is properly seated on the printhead portion 26. The compression of the porous material 34 in the region of the fluid inlet 30 tends to provide a region of increased capillarity in the porous material 34, thereby tending to draw ink within the reservoir toward the fluid inlet 30. Ink, once in the fluid inlet 30, flows to the printhead 38. The printhead 38 is responsive to activation signals provided by the printer portion 12 to selectively deposit ink on media.

Figure 3:
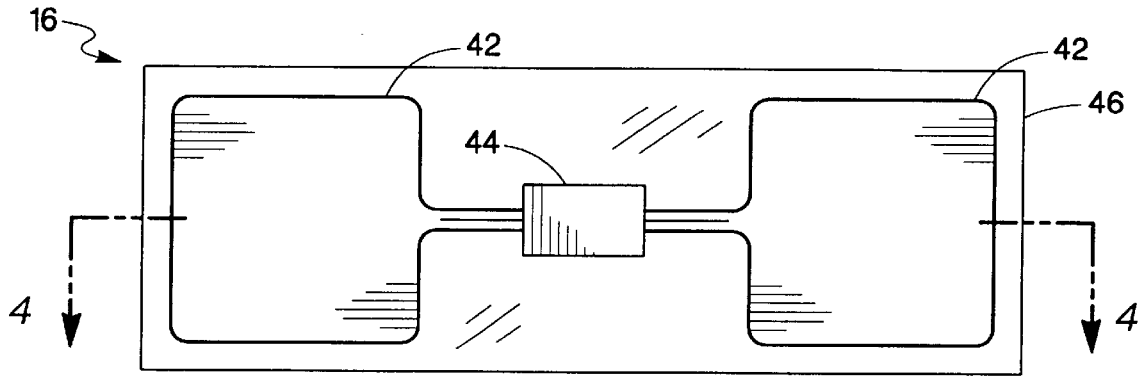
FIG. 3 is an underside plan view of a sensor and a linking device that are integrated into a label for attachment to the ink reservoir shown in FIG. 2.

FIG. 3 is a representation of the linking device 16 for transferring information between the replaceable printing component 14 and the printer portion 12. The linking device 16 includes a sensor 42 for determining status information related to the replaceable printing component 14 and a link 44 for transferring information between the replaceable printing component 14 and the printer portion 12. In a preferred embodiment, the sensor 42 is a pair of conductive electrodes that are electrically connected to the link 44. In this preferred embodiment, the electrodes 42 are defined by the deposition of conductive ink on a label 46.

Figure 4:
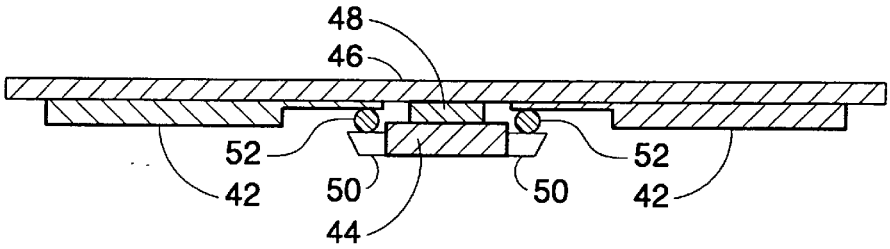
FIG. 4 is a section view taken across lines 4—4 of the label, sensor, and linking device shown in FIG. 3.

FIG. 4 shows the linking device 16 in cross-section taken across lines 4—4 of FIG. 3. As shown in FIG. 4, the linking device 16 includes the link 44 that is attached to the label portion 46 by an adhesive 48 which securely binds the link 44 to the label 46. The sensor 42 is defined by depositing conductive ink on the label 46 to form electrodes. The size and shape of the electrodes will depend on the particular type of sensing arrangement. For example, in sensing a fluid level using a capacitive sensing technique, the electrodes extend over a large area on either side of the ink reservoir 24 as shown in FIGS. 3, 4, 5 and 6. Electrodes for sensing fluid level using a conductive technique, in contrast, need not cover a large area, but instead, need only provide an electrical potential to selected portions on either side of the ink reservoir 24 as shown in FIG. 7.

The sensor 42 or electrodes are electrically connected to the link 44 so that status information is provided to the link 44. The link 44 includes a pair of electrical contacts 50 that are electrically connected to the sensor 42 using a conductive material such as an electrically conductive adhesive 52. The electrically conductive adhesive forms electrical continuity between a sensor 42 and the link 44.

Figure 5:
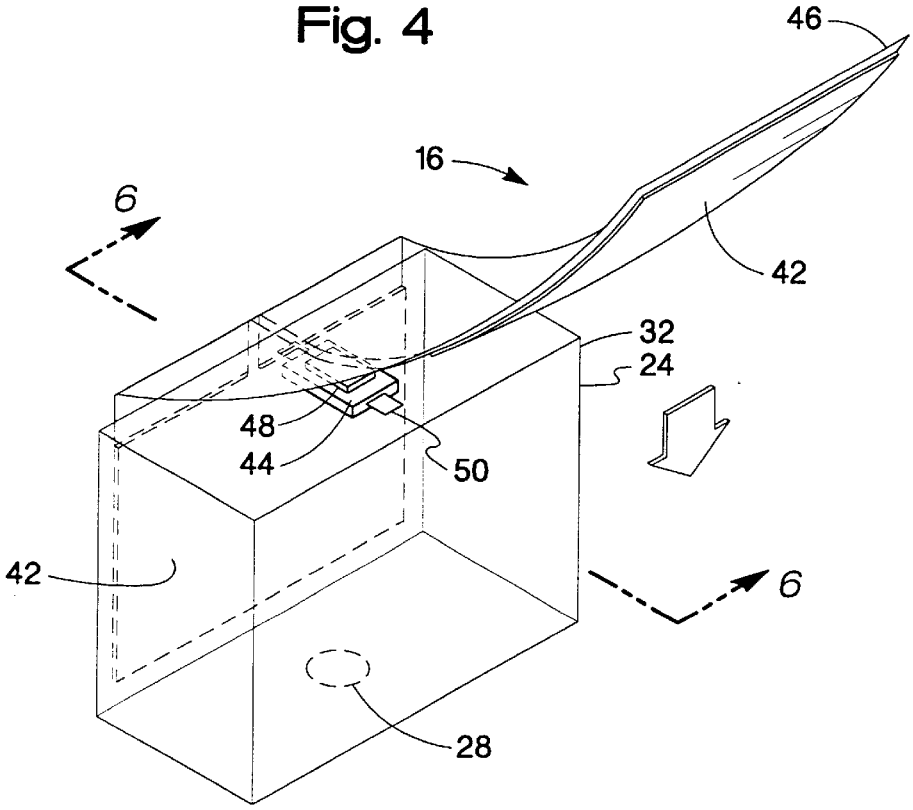
FIG. 5 depicts positioning of the label, sensor, and linking device of FIG. 3 onto the ink container portion shown in FIG. 2.

FIG. 5 shows the linking device 16 partially positioned on the replaceable printing component 14. The linking device 16 is attached to the ink reservoir 24 with the application of the label 46 to the ink reservoir 24. The label 46 is preferably adhesively attached to the to ink reservoir 24. On a side of the label 46 opposite the sensor 42, product identification information can be printed.

Figure 6:
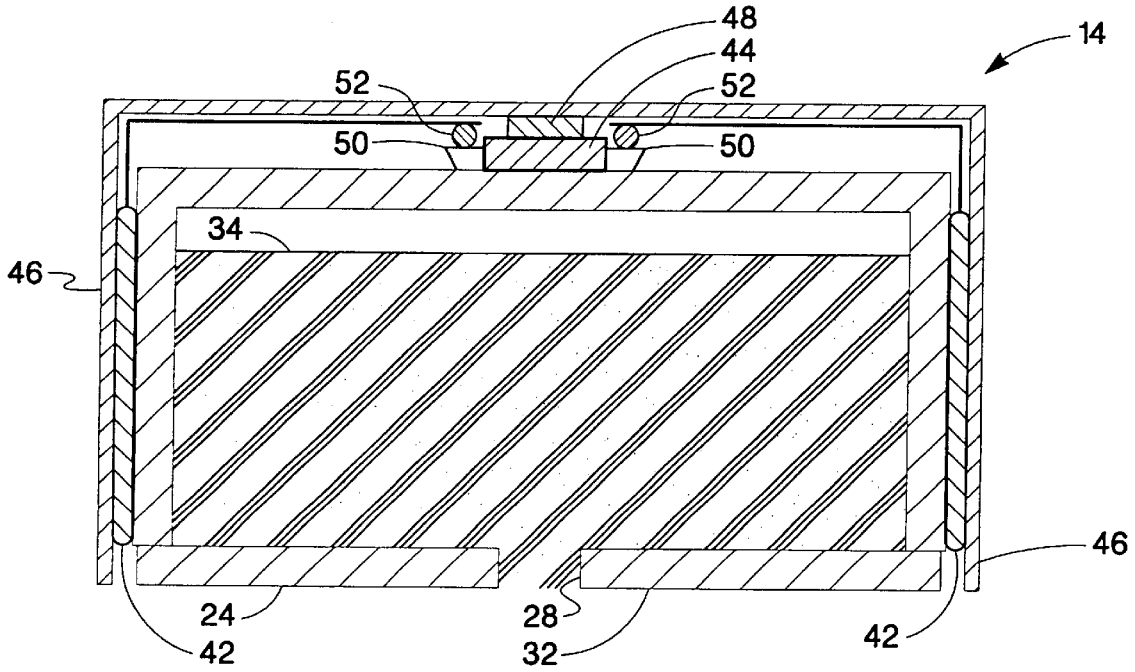
FIG. 6 is a section view of the ink container of FIG. 5 with the label, sensor and linking device positioned on the ink reservoir portion.
Figure 7:
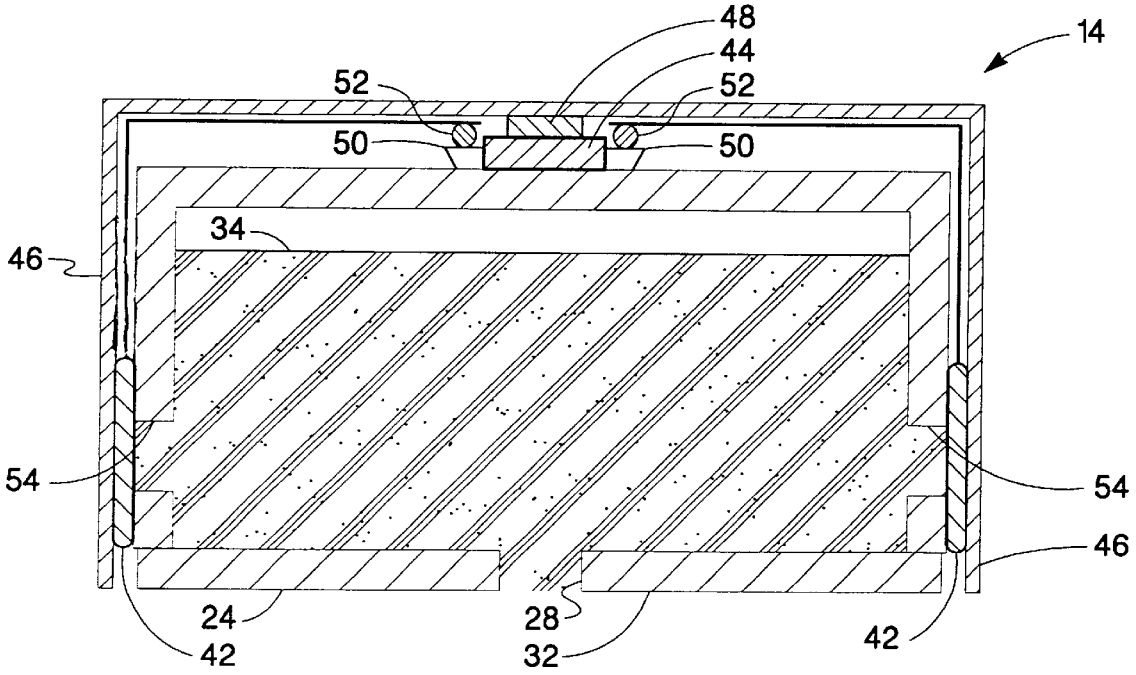
FIG. 7 depicts an alternative embodiment of the sensor, linking device and ink reservoir portion shown in FIG. 6.

FIG. 6 is a section view of the replaceable printing component 14 shown in FIG. 5 with the label 46, sensors 42, and link 44, positioned on the ink reservoir 24. The sensor 42 in this preferred embodiment has electrodes that define a large area on either side of the ink reservoir 24. A capacitance can be sensed that the linking device 44 sees between the pair of sensors 42. This capacitance value varies with an amount of ink within the ink reservoir 24. Therefore, based on a measured capacitance value an ink level within the ink reservoir 24 can be inferred. The link 44 then sends ink level information or ink level status of the replaceable printing component 14 by determining ink level based on capacitance between the electrodes or sensors 42. The link 44 emits a radio frequency signal or a broadcast signal for transferring this ink level information to the printer portion 12 as will be discussed with respect to FIGS. 8 and 9.

FIG. 7 represents an alternative embodiment of the linking device 16 for sensing status of a replaceable printing component and providing status to the printer portion 12. The ink reservoir 24 is identical to the ink reservoir shown in FIG. 6 except that the housing 32 defines a pair of openings 54 on either side of the ink reservoir 24. This pair of openings 54 is preferably positioned at a lower region of the ink reservoir 24 relative to a gravity frame of reference. The sensor 42 or electrodes need not define a large area as in FIG. 6, but instead need only provide electrical contact to the absorbent material 34 within the ink reservoir 24. The linking device 44 then receives a conductivity signal between the pair of electrodes which is indicative of ink within the absorbent material 34 in the region between the pair of openings 54. Because both gravity and capillary gradient will tend to draw remaining ink within the reservoir 24 toward the fluid outlet 28, the absorbent material 34 between the pair of openings 54 will remain wet with ink until the ink reservoir 24 is exhausted or nearly exhausted of ink. As the ink reservoir 24 becomes exhausted of ink, the conductivity between the electrodes 42 changes with changing conductivity between the openings 54. Therefore, the link 44 that is electrically connected to electrodes 42 can determine an ink level status in the ink reservoir 24 based on conductivity in a specified region of the ink container 24. The link device 44 can pass the ink level or status signal, such as a low ink signal or an out-of-ink signal, to the printing portion 12.

Figure 8:
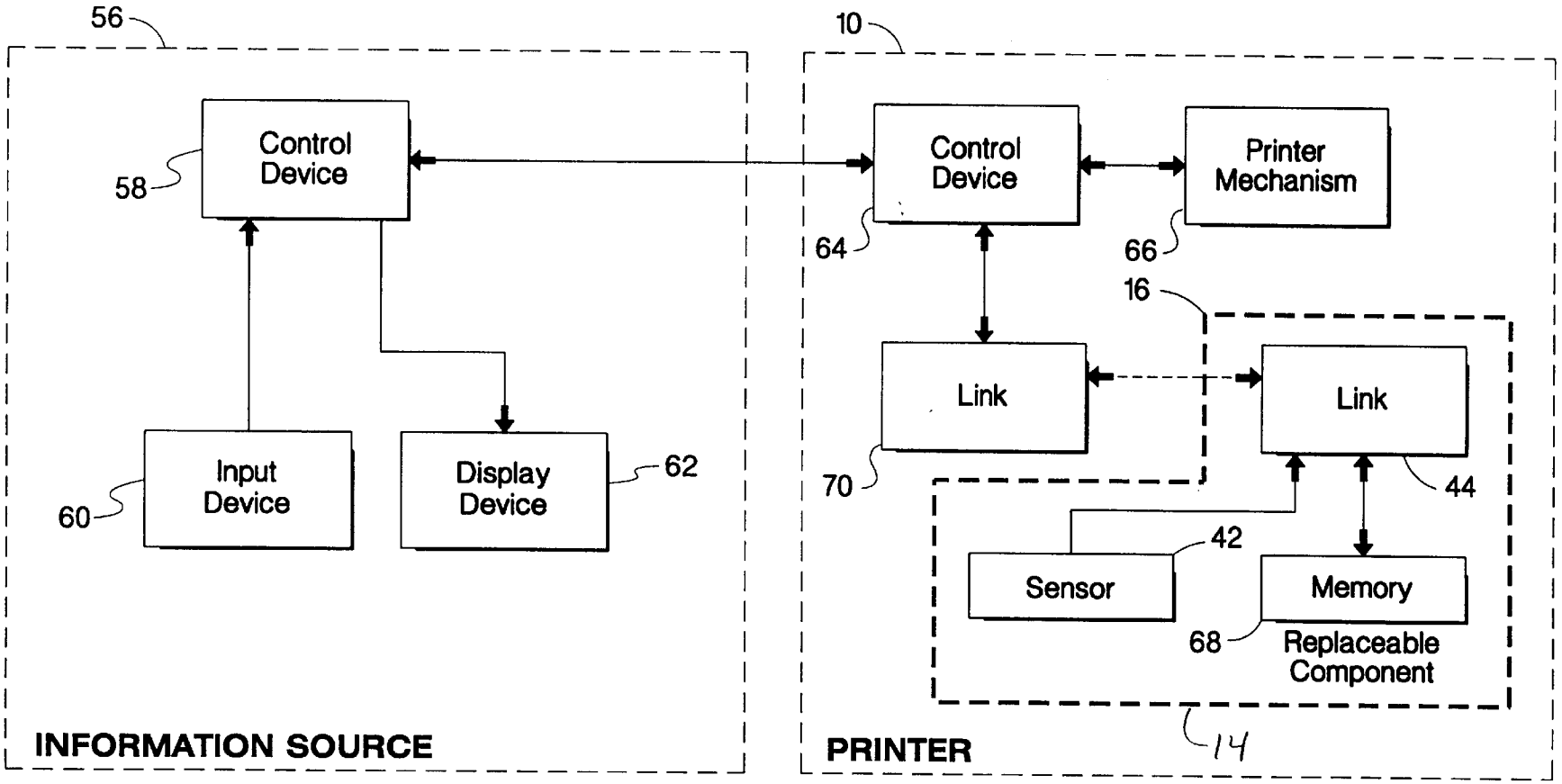
FIG. 8 is an electrical block diagram showing the printing system having a printer portion connected to a host with the replaceable printing component linked to the printer portion for transferring information therebetween.

FIG. 8 is a simplified block diagram of the printing system 10 of the present invention shown connected to an information source or host device 56. The information source 56 provides information such as image descriptions to the printing system 10 for printing on print media. The information source 56 includes a control device 58, an input device 60, and a display device 62. The control device 58 is a microprocessor, a microprogram device, or a hardware implemented device. The control device 58 is connected to a display device 62 such as a monitor and receives input from the input device 60 such as a keyboard. The information source 56 can be any source of information that is acceptable to the printing system 10 such as a personal computer, work station, web appliance, digital camera or server, to name a few.

The printing system 10 includes a control device 64 for receiving image information from the information source 56 and controlling a printer mechanism 66 accordingly for forming images on print media. The control device 64 associated with the printing system 10 in the case of an inkjet printer formats image information and stores this image information for controlling various printing system 10 functions to accomplish printing. These printing system 10 functions include controlling the motion of the scanning carriage 18, controlling the media feed to step print media 22 through the print zone, and activating the printhead 38 to deposit ink on print media 22 so as to form an image on this media which corresponds to the image information received from the information source.

The printing system 10 includes the linking device 16 associated with the replaceable printing component 14. The linking device 16 includes the link 44 and the sensor 42. In one preferred embodiment, the linking device 16 includes an electrical storage device 68 such as a semiconductor memory that is electrically connected to the link 44. The link 44 together with a corresponding link 70 that is electrically connected to the control device 64, allows information to be transferred between the linking device 16 and the printing system 10 without direct electrical contact. The link 44 associated with the replaceable printing component and the link 70 associated with the printing system 10 do not require electrical interconnects to pass information therebetween. Among the information passed between the link 44 and the link 70 includes status information that is either determined from the sensor 42 or the electrical storage device 68. This status information includes marking material status such as a low ink signal or a signal indicative of remaining ink. In addition, information regarding various parameters associated with the replaceable printing component 14 that are stored in the electrical storage device 68 can be passed between links 44 and 70.

The status of the replaceable printing component 14 can be retrieved either under control of the control device 64 such as at periodic intervals, or status can be requested by the customer. The customer can request status of the replaceable printing component 14 either through the information source 56 or through the use of an input device such as a switch associated with the printing system 10 that provides a request through the control device 64. In response to the request for a replaceable printing component 14 status, the control device 64 retrieves status information either for printing this information using the printer mechanism 66 or displaying this information using the display device 62 associated with the information source 56.

Figure 9:
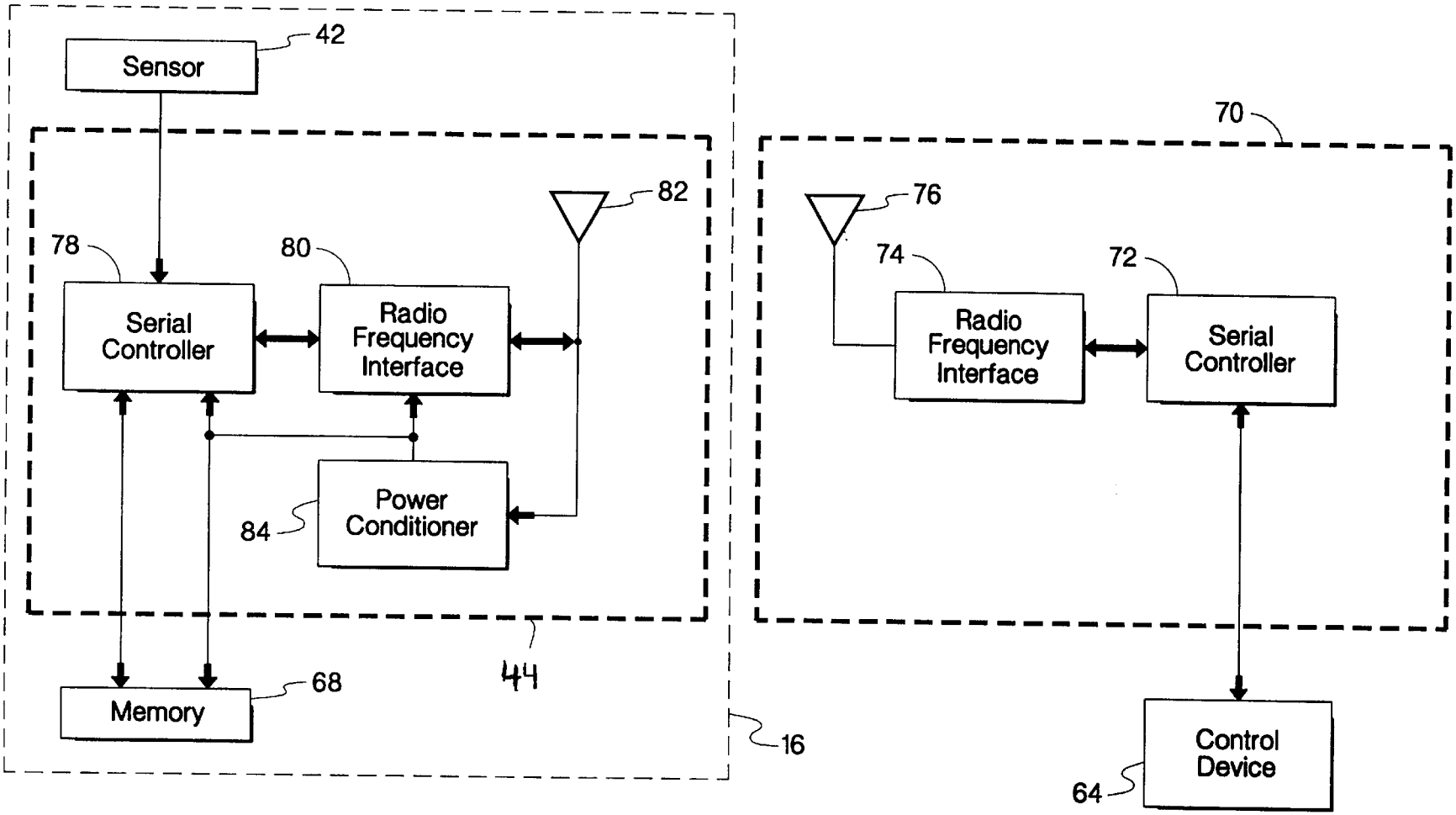
FIG. 9 is a simplified block diagram of the linking devices associated with each of the replaceable printing components and the printer portion.

FIG. 9 depicts further detail of the link devices 44 and 70 of the present invention for transferring status information between the replaceable printing component 14 and the printing system 10. The linking device 70 associated with the printing system 10 includes a serial controller 72, a radio frequency interface 74, and an antenna 76. The serial controller 72 controls the transfer of information between the control device 64 associated with the printing system 10 and the radio frequency interface 74. The serial controller 72 is preferably a microprocessor, a programmable controller or a hardware implemented controller that performs the necessary interface and data manipulation functions for passing information between the control device 64 and the radio frequency interface 74. Information transferred between the control device 64 and the serial controller 72 includes command information for requesting status as well as the status information itself. This command information is provided to the linking device 16, whereupon the linking device 16, provides the requested status information. In one preferred embodiment, information is transferred between the serial controller 72 and the control device 64 in a parallel format, and information is transferred between the serial controller 72 and the radio frequency interface 74 in a serial format.

The radio frequency interface 74 receives information from the serial controller 72 in a serial fashion and converts this information into time varying voltages at the antenna 76. These time varying voltages are preferably in a standard radio frequency range such as 125 kilohertz to 13.56 megahertz. Radio frequencies outside this range may also be suitable. Transmission of information using a radio frequency technology is used in financial transaction cards provided by financial institutions for various types of transactions such as banking and using debit cards and credit cards. These financial transaction cards are sometimes referred to as "smart cards". Similar technology is also used in inventory systems that are sometimes referred to as radio frequency identification (RFID) technology.

The link 44 associated with the linking device 16 is similar to the link device 70 associated with the printing system 10. The link 44 includes a serial controller 78, a radio frequency interface 80 and an antenna 82, each of which are similar to corresponding features of the link 70. The voltages are induced on antenna 82 in response to time varying voltages provided to antenna 76. Information is extracted from the time varying voltages induced on antenna 82 by the radio frequency interface 80. Information is passed from the radio frequency interface 80 to the serial controller 78. In response to command information, the serial controller 78 can store information such as ink parameter information or ink level information in the electrical storage device 68. In addition, in response to command information, the serial controller retrieves information from the electrical storage device 68 or the sensor 42 depending which information is selected. The information such as ink level information from the sensor 42 is transferred to the serial controller 78 to be sent to the link 70 associated with the printer portion 12 in a manner similar to the transfer of information from the link 70 to link 44.

In the preferred embodiment, each of the link 44 and the electrical storage device 68 associated with the linking device 16 is either an active device powered by a battery or a passive device that stores energy in a storage device such as a capacitor. In the case of a passive device, energy is provided to the capacitor by voltages induced on the antenna 82. In the preferred embodiment, voltages are induced on the antenna 82 due to time varying voltages that are applied to the antenna 76 by the radio frequency interface 74. The induced voltage at the antenna 82 is provided to a power conditioner 84 which converts these time varying voltages into a single polarity voltage that is suitable as a supply voltage for each of the electrical storage device 68, the serial controller 78 and the radio frequency interface 80. In one preferred embodiment, the power conditioner 84 rectifies a time varying voltage that is induced on the antenna 82 and filters this rectified voltage to provide a suitable supply voltage.

To power the link 44, a time varying electromagnetic field induces a voltage on antenna 82. The modulation of this time varying electromagnetic field allows information to be transferred to the link 44. For example, a carrier signal can be provided by the link 70 to induce a time varying voltage at antenna 82. This time varying voltage is rectified and filtered by the power conditioner 84 to provide a supply voltage to the link 44 and electrical storage device 68. The radio frequency interface 74 modulates the carrier signal such that by varying the frequency, phase or amplitude, information is transmitted to the link 44. The modulation of the carrier signal allows the radio frequency interface 80 to extract information from the carrier signal. Information is transferred in a similar manner from the link 44 back to the link 70. Use of a power conditioner 84 on the link 44 eliminates the need for a direct power and ground connection between the linking device 16 and the printing system 10.

The present invention is applicable to a variety of other types of printing systems 10 as well. For example, the present invention is suitable for use with electrophotographic printing systems. In the case of electrophotographic printing systems, the replaceable printing component is a replaceable component such as a supply of printing material usually referred to as a toner cartridge. The sensor 42 determines toner level information from the toner cartridge and provides this information to the printer portion using the wireless connection established by links 44 and 70. The printer portion 12 notifies the customer of a low toner condition or an out of toner condition so that the toner cartridge can be replaced.

In operation, the control device 64 associated with the printing system 10 requests status of the replaceable printing component 14. The replaceable printing component determines its status by using a sensor 42 such as an ink level sensor. The status information is retrieved from the sensor 42 by the link 44. The link 44 then transmits the status information to the link 70. The link 70 then provides the status information to the control device 64. The control device 64 responds to the status information accordingly. For example, upon an out-of-ink condition, the control device 64 notifies the customer of this condition so that the replaceable printing component 14 can be replaced.

The use of the linking device 16 is a relatively low cost method for determining status such as ink level condition of a replaceable ink reservoir 34. The linking device 16 is added to the ink reservoir using a relatively low cost manufacturing technique of applying a label to the ink reservoir. This technique does not require a high degree of alignment, nor does this system require difficult manufacturing steps.

What is claimed is:

1. An ink level sensing system for determining ink level in an ink reservoir of a replaceable printing component and providing this ink level information to a printing system, the ink level sensing system comprising:

a pair of electrodes for sensing ink level in the ink reservoir of the replaceable printing component; and a wireless radio frequency interface electrically connected to the pair of electrodes, the wireless radio frequency interface receiving ink level information from the pair of electrodes indicative of the ink level in the ink reservoir of the replaceable printing component and wirelessly transferring the ink level information between the wireless radio frequency interface and a wireless linking device associated with the printing system.

2. The ink level sensing system of claim 1 wherein the wireless radio frequency interface is electrically connected between the pair of electrodes and wherein the pair of electrodes provide an output signal indicative of ink level within the ink reservoir to the wireless radio frequency interface.

3. The ink level sensing system of claim 1 wherein the wireless radio frequency interface includes an antenna for broadcasting a radio frequency signal to the wireless linking device associated with the printing system.

4. The ink level sensing system of claim 1 wherein the wireless radio frequency interface and the pair of electrodes are incorporated into a label that is adhesively applied to the ink reservoir of the replaceable printing component.

5. The ink level sensing system of claim 1 wherein the pair of electrodes are disposed on the ink reservoir to measure electrical continuity through ink within the ink reservoir and wherein continuity within the ink reservoir is dependent on the ink level within the ink reservoir.

6. The ink level sensing system of claim 1 wherein the pair of electrodes are disposed on the ink reservoir to measure capacitance between the pair of electrodes and wherein the capacitance between the pair of electrodes changes with the ink level within the ink reservoir.

7. A replaceable printing component for use in a printing system, the replaceable printing component for containing a supply of printing material for use by the printing system to form images on media, the replaceable printing component comprising:

a sensor for sensing printing material in the replaceable printing component, the sensor providing a sensor output signal indicative of a printing material level in the replaceable printing component; and a wireless linking device electrically connected to the sensor, the wireless linking device emitting a wireless broadcast signal indicative of the sensor output signal, the printing system having a corresponding wireless linking device for receiving the wireless broadcast signal and determining the printing material level in the replaceable printing component.

8. The replaceable printing component of claim 7 wherein the wireless linking device is a radio frequency linking device for broadcasting a radio frequency signal.

9. The replaceable printing component of claim 7 wherein the replaceable printing component is a replaceable ink reservoir and wherein the sensor provides an output signal indicative of ink within the ink reservoir.

10. The replaceable printing component of claim 7 wherein the replaceable printing component is a replaceable ink reservoir and wherein the sensor includes pair of electrodes disposed on the ink reservoir to measure electrical continuity through ink within the ink reservoir and wherein continuity within the ink reservoir is dependent on ink level within the ink reservoir.

11. The ink level sensing system of claim 7 wherein the replaceable printing component is a replaceable ink reservoir and wherein the sensor includes a pair of electrodes that are disposed on the ink reservoir to measure capacitance between the pair of electrodes and wherein the capacitance between the pair of electrodes changes with ink level within the ink reservoir.

12. A printing system having a printer portion and at least one replaceable printing component, the printer portion and the at least one replaceable printing component exchanging information therebetween, the printing system comprising:

a first wireless link associated with the replaceable printing component, wherein the first wireless link is electrically connected to a sensor for sensing operational status of the replaceable printing component for providing replaceable printing component operational status information; and a second wireless link associated with the printer portion, the second wireless link receiving the replaceable printing component operational status information through the atmosphere from the first wireless link for determining operational status of the replaceable printing component.

13. The printing system of claim 12 wherein the first wireless link is a radio frequency transmitter for transmitting a radio frequency signal having the replaceable printing component operational status information contained therein and the second wireless link is a radio frequency receiver for receiving the radio frequency signal and determining the operational status of the replaceable printing component based thereon.

14. The printing system of claim 12 wherein the replaceable printing component is a replaceable ink reservoir and wherein the replaceable printing component operational status information is ink level information in the ink reservoir.

15. The printing system of claim 12 wherein the replaceable printing component is a replaceable ink reservoir and wherein the sensor includes a pair of electrodes that are disposed on the ink reservoir to measure electrical continuity through ink within the ink reservoir and wherein continuity within the ink reservoir is dependent on ink level within the ink reservoir.

16. The printing system of claim 12 wherein the replaceable printing component is a replaceable ink reservoir and wherein the sensor includes a pair of electrodes that are disposed on the ink reservoir to measure capacitance between the pair of electrodes and wherein the capacitance between the pair of electrodes changes with ink level within the ink reservoir.

17. The printing system of claim 12 wherein the printer portion is an ink jet printer and wherein the replaceable printing component includes a reservoir portion for containing ink.

18. A method for transferring ink level information for an ink reservoir of a replaceable printing component from the replaceable printing component to a printer portion, the method comprising:

determining the ink level information for the ink reservoir of the replaceable printing component using a pair of electrodes; and transmitting the ink level information through the atmosphere from a first wireless link associated with the replaceable printing component and electrically connected to the pair of electrodes to a second wireless link associated with the printer portion.

19. The method of claim 18 wherein the printer portion is an ink jet printer.

20. The method of claim 18 and further including:

receiving the ink level information at the printer portion using the second wireless link; and responding to the ink level information accordingly.

21. The method of claim 18 wherein the step of transmitting the ink level information is accomplished using a radio frequency link that defines the first wireless link.

* * * * *